US006550833B2

(12) United States Patent
Haynes

(10) Patent No.: US 6,550,833 B2
(45) Date of Patent: Apr. 22, 2003

(54) MULTI-UNIT CONCRETE BLOCK TONGS

(76) Inventor: Scott D. Haynes, 7801 Amber Hill Rd., Lincoln, NE (US) 68516

( * ) Notice: Subject to any disclaimer, the term of this patent is extended or adjusted under 35 U.S.C. 154(b) by 36 days.

(21) Appl. No.: 09/951,258

(22) Filed: Sep. 12, 2001

(65) Prior Publication Data

US 2003/0046884 A1 Mar. 13, 2003

(51) Int. Cl.[7] ..... B66C 1/44
(52) U.S. Cl. ..... 294/63.1; 294/104; 52/125.2
(58) Field of Search ..... 294/62, 63.1, 104, 294/110.1; 52/125.2, 749.13

(56) References Cited

U.S. PATENT DOCUMENTS

| | | | | | |
|---|---|---|---|---|---|
| 1,192,504 | A | * | 7/1916 | Crum | 294/63.1 |
| 2,370,528 | A | * | 2/1945 | Fontaine | 294/63.1 |
| 2,782,067 | A | * | 2/1957 | Bonte et al. | 294/104 |
| 2,866,660 | A | * | 12/1958 | McGuire et al. | 294/63.1 |
| 2,924,484 | A | * | 2/1960 | Tolsma | 294/104 |
| 3,614,151 | A | * | 10/1971 | Shadle | 294/104 |
| 4,545,609 | A | * | 10/1985 | Pasquazzi et al. | 294/104 |
| 5,820,180 | A | * | 10/1998 | Haupt | 294/104 |

FOREIGN PATENT DOCUMENTS

| | | | | |
|---|---|---|---|---|
| GB | 2252071 | * | 7/1992 | |
| JP | 406080372 | * | 3/1994 | 294/110.1 |

* cited by examiner

*Primary Examiner*—Eileen D. Lillis
*Assistant Examiner*—Paul T. Chin
(74) *Attorney, Agent, or Firm*—Thomte, Mazour & Niebergall; Dennis L. Thomte

(57) ABSTRACT

A concrete block tong assembly which is designed to lift and transport a plurality of concrete blocks. The assembly is provided with three top tubes pivotally connected at one end thereof to one end of three bottom tubes. A lifting apparatus is operatively connected to the top three tubes whereupon upward movement of the top three tubes by the lifting mechanism will cause the top tubes to pivot with respect to the bottom tubes. A front plate is secured to one end of each of the top tubes for movement therewith and a back plate is longitudinally adjustably secured to each of the bottom tubes adjacent the other end thereof. A solenoid operated dead bolt is selectively movably mounted within each of the top tubes and is movable between extended and retracted positions. An upstanding support is provided on each of the bottom tubes adapted to receive the dead bolt of the associated top tube to lock the assembly in its open position. When the solenoids are activated, the dead bolts are retracted into the top tubes so that when the lifting device raises the assembly, the top tubes pivot with respect to the bottom tubes to urge the front plates and back plates of the assembly into frictional engagement with the ends of the concrete blocks.

7 Claims, 5 Drawing Sheets

MULTI-UNIT CONCRETE BLOCK TONGS

BACKGROUND OF THE INVENTION

1. Field of the Invention

This invention relates to block tongs and more particularly to a multi-unit block tong assembly which may be used to lift and transport large building blocks such as those used in retaining walls, steps, etc.

2. Description of the Related Art

Brick tongs have been used for many years to enable a workman to carry a plurality of bricks from a source of supply to a work site. The conventional brick tongs comprise plates or hooks disposed at ends of a pair of pivoting arms designed so that when the tongs are lifted, the plates or hooks are moved into engagement with the ends of the outermost bricks so that the bricks are firmly grasped to enable the bricks to be lifted and carried. During the past several years, large concrete blocks have been fabricated for use in retaining walls, steps, etc. The blocks are quite large and heavy and are difficult for a workman to move from a pallet or the like to the job site.

In the past, applicant devised a multi-unit concrete block tong assembly wherein the block tongs could lift and carry a plurality of concrete blocks from a pallet to the job site with the block tongs being supported from the end of a boom mounted on a skid-steer loader or the like. Although the block tongs of applicant's previous device did perform satisfactorily, the previous device required the presence of a worker to permit the block tongs to be selectively locked into the open position so that the tongs could be mounted on the concrete blocks and so that the block tongs could be removed from the concrete blocks once the blocks were properly positioned adjacent the job site.

SUMMARY OF THE INVENTION

A multi-unit concrete block tong assembly is provided which includes three top tubes pivotally connected at one end thereof to one end of three bottom tubes. A lifting apparatus is operatively connected to the three top tubes whereupon upward movement of the three top tubes by the lifting device will cause the top tubes to pivot with respect to the bottom tubes. A front plate is secured to one end of each of the top tubes for movement therewith. A back plate is longitudinally adjustably secured to each of the bottom tubes adjacent the other end thereof. A solenoid operated dead bolt is selectively movably mounted within each of the top tubes and is movable between extended and retracted positions. A spring is positioned within each of the top tubes for moving the dead bolt therein to its extended position. The solenoid is operatively connected to each of the dead bolts for moving the dead bolt from its extended position to its retracted position. An upstanding support is provided on each of the bottom tubes adapted to receive the dead bolt of the associated top tube to lock the assembly in its open position. When the solenoids are activated, the dead bolts are retracted into the top tubes so that when the lifting device raises the assembly, the top tubes pivot with respect to the bottom tubes to urge the front plates and back plates of the assembly into frictional engagement with the ends of the concrete blocks.

It is therefore a principal object of the invention to provide an improved multi-unit concrete block tong assembly.

A further object of the invention is to provide a multi-unit concrete block tong assembly which includes a solenoid operated dead bolt designed to lock the assembly in its open position, thereby eliminating the need for the presence of a worker.

A further object of the invention is to provide a concrete block tong assembly which is designed to lift and carry a plurality of concrete blocks.

A further object of the invention is to provide a concrete block tong assembly including means for rotating the same to properly position the assembly with respect to the concrete blocks to be lifted and carried and to permit the concrete blocks to be properly positioned within or at the job site.

These and other objects will be apparent to those skilled in the art.

DESCRIPTION OF THE PREFERRED EMBODIMENT

Figure 1:
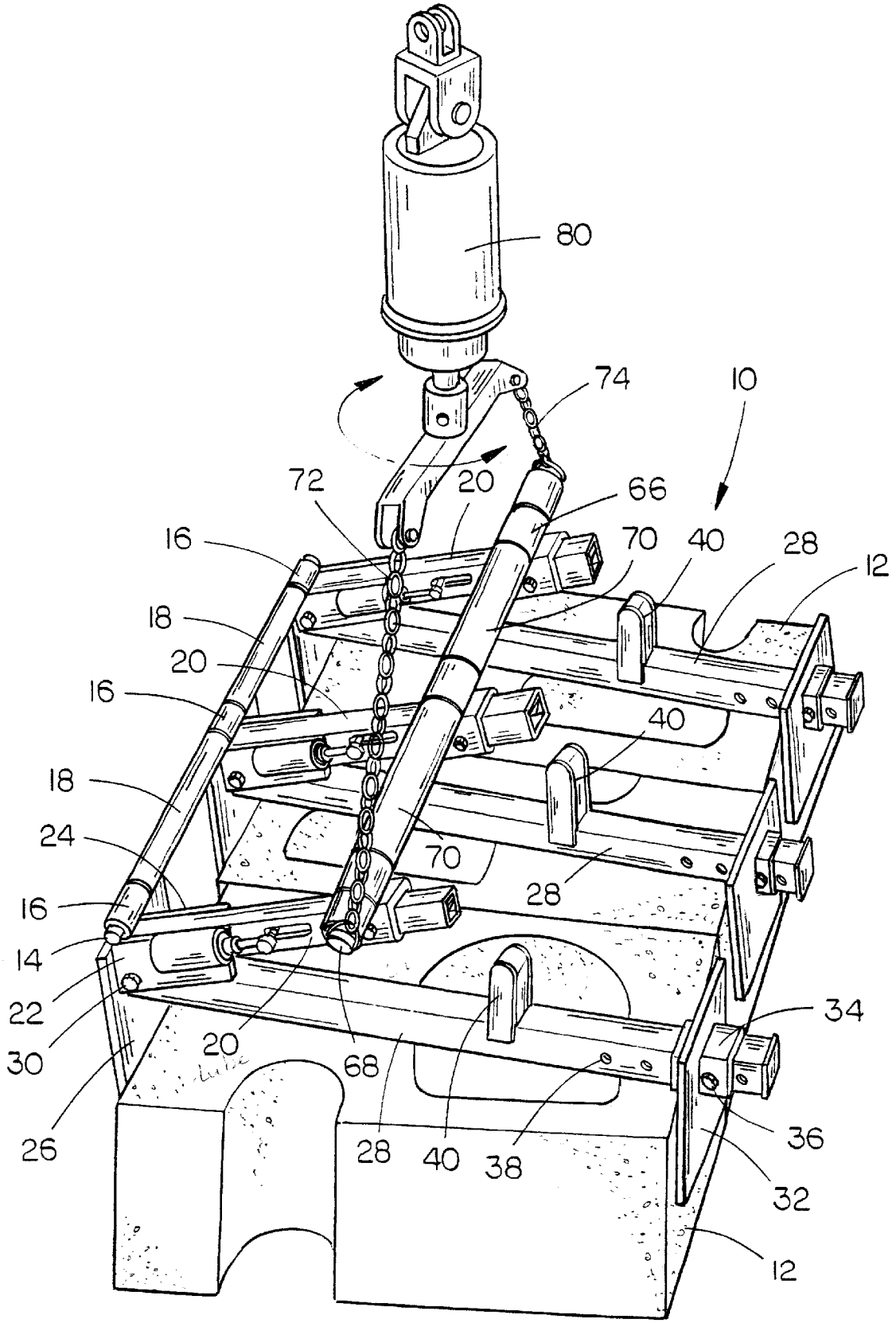
FIG. 1 is a perspective view illustrating the assembly of this invention lifting a plurality of concrete blocks.
Figure 2:
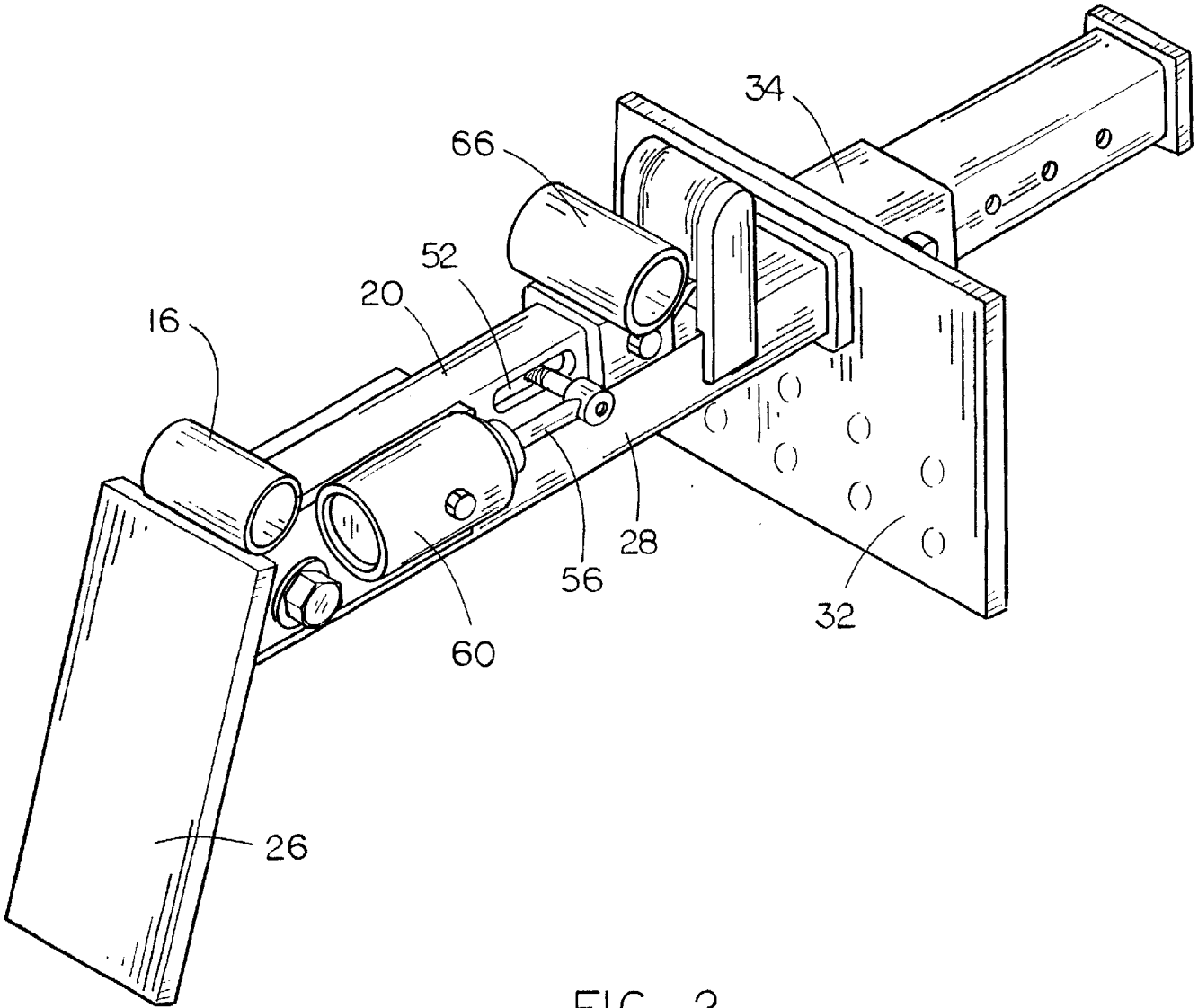
FIG. 2 is a perspective view of one of the units of the assembly.
Figure 3:
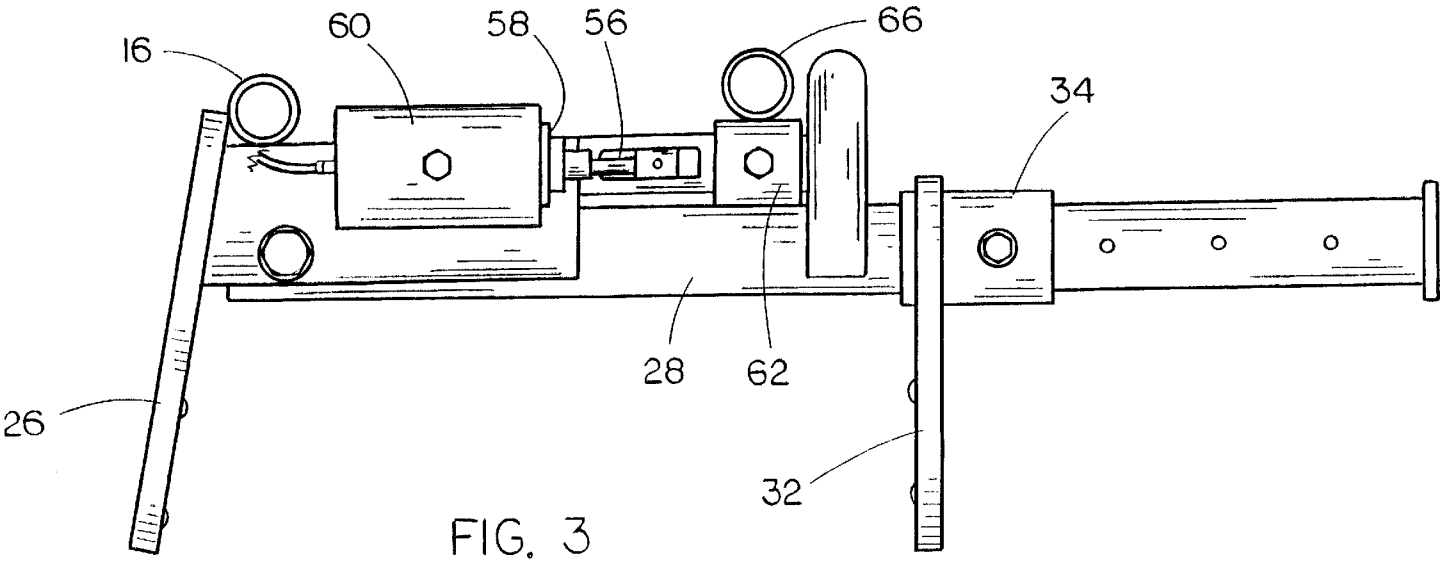
FIG. 3 is a side view of one of the units of the assembly.
Figure 4:
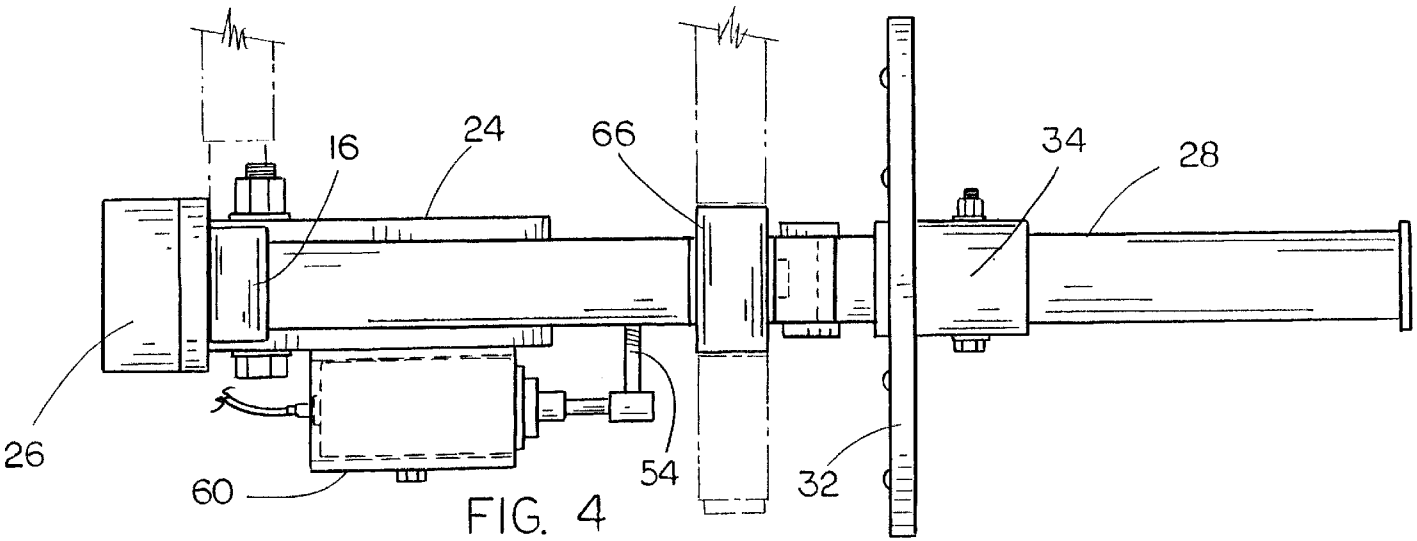
FIG. 4 is a top elevational view of the unit of FIG. 3.

The block tong assembly of this invention is referred to generally by the reference numeral 10. Assembly 10 is designed to grasp and lift a plurality of blocks 12 such as those commonly used for retaining walls, steps, etc. Assembly 10 includes a first shaft 14 having sleeves or collars 16 rotatably mounted thereon which have sleeves or collars 18 positioned therebetween. Assembly 10 includes a plurality of horizontally spaced-apart top tubes 20, the number of which will depend upon the size of the assembly. One end of each of the top tubes 20 is welded to a collar 16 for rotation therewith. Saddle plates 22 and 24 are welded to opposite sides of one end of the tube 20 and have a front plate 26 welded thereto which extends downwardly therefrom, as seen in FIGS. 1 and 2. A bottom tube 28 has one end thereof received between the saddle plates 22 and 24 and is pivotally secured thereto by means of a bolt or pin 30 to enable the top tubes 20 to be pivotally movable with respect to bottom tubes 28 from a first position to a second position. When top tubes 20 are in the first position with respect to bottom tubes 28, the top tubes 20 are substantially parallel to the bottom tubes 28. When in their second position, top tubes 20 are angularly disposed with respect to the bottom tubes 28.

A back plate 32 is selectively longitudinally mounted on each of the bottom tubes 28, as seen in FIG. 1. Back plate 32 has a collar 34 welded thereto which is adapted to have a bolt or pin 36 extended therethrough with the bolt or pin 36 being received in one of the openings 38 formed in bottom tube 28. The numeral 40 refers to an upstanding support which is secured to each of the bottom tubes 28 adjacent the end of the associated top tube 20. Each of the supports 40 has a recessed portion 42 formed in one side thereof which defines an upper shoulder 44.

Figure 5:
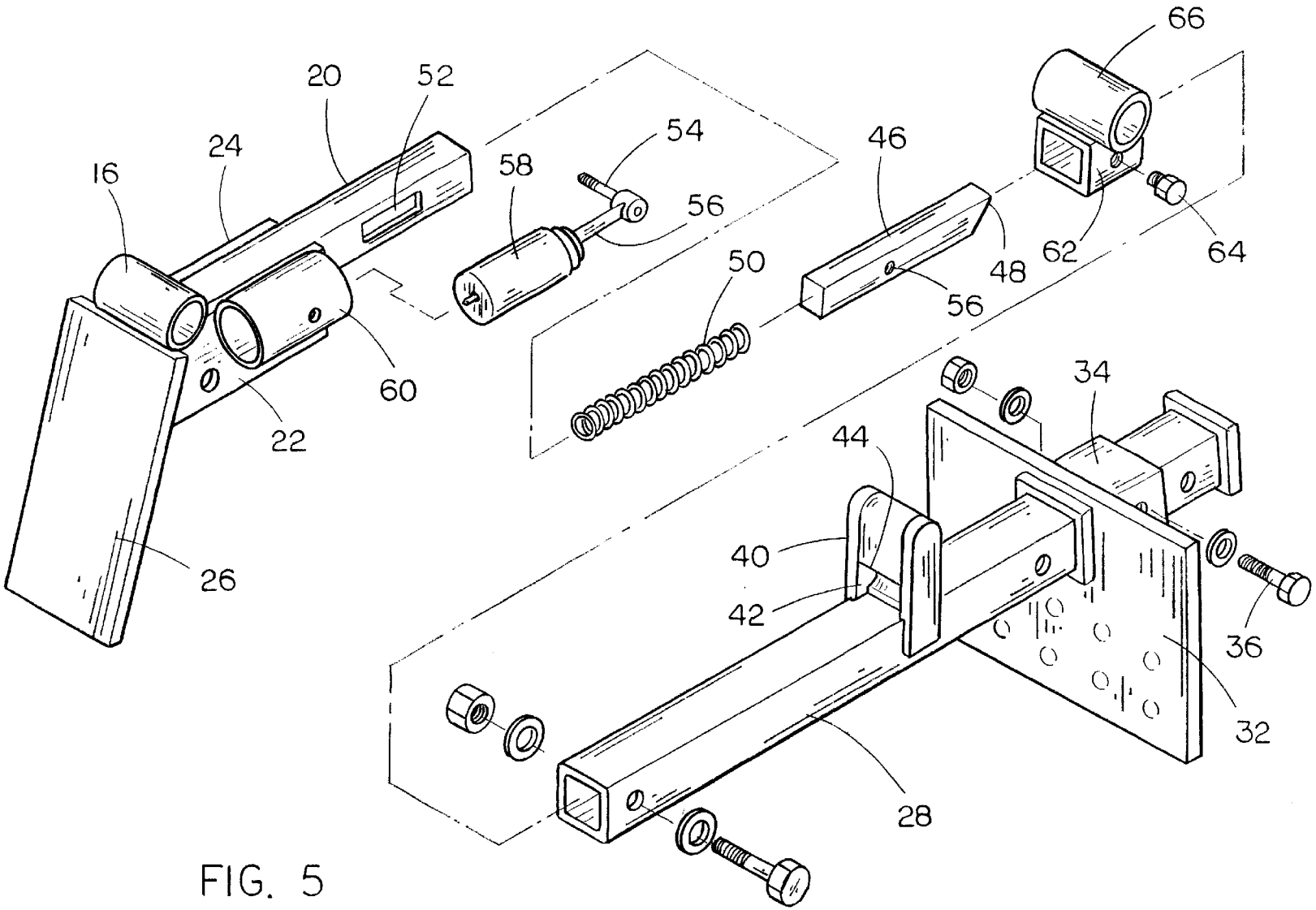
FIG. 5 is an exploded perspective view of one of the units of the assembly.
Figure 6:
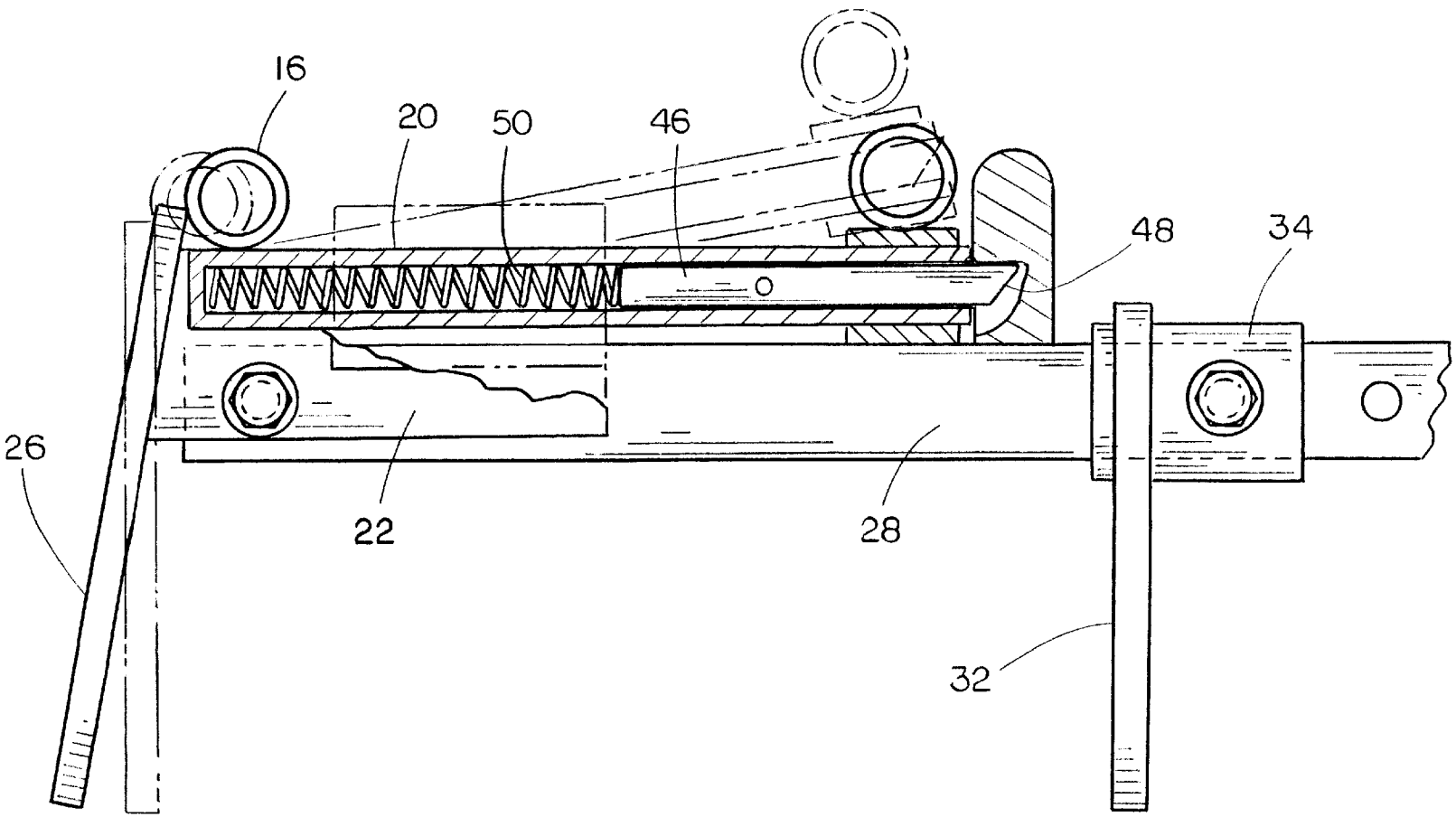
FIG. 6 is a partial sectional view illustrating the manner in which one of the units is locked into its open position with the broken lines illustrating the pivotal movement of the top tube with respect to the bottom tube when the dead bolt has been retracted and the lifting device has pivotally moved the top tube with respect to the bottom tube.

Each of the top tubes 20 has a dead bolt 46 slidably mounted therein which has an end portion 48 which is receivable within the recessed area 42 of support 40. Spring 50 is positioned in top tube 20 for urging dead bolt 46 into engagement with the support 40. Top tube 20 has a slot 52 formed in one side thereof which receives a bolt or stud 54 which is secured to the dead bolt 46 at 56. Bolt 54 extends transversely from the actuator rod 56 of electric solenoid 58. Solenoid 58 is mounted under collar 60 which is secured to top tube 20, as seen in FIG. 5. Solenoid 58 is adapted to selectively retract the dead bolt 46 from its engagement with the support 40. When solenoid 58 is disengaged, spring 50 urges dead bolt 46 to its extended position.

A tubular collar 62 is selectively longitudinally adjustably mounted on each of the top tubes 20 and is held in place by means of the set screw 64. A cylindrical sleeve 66 is welded to collar 62 for reception of the shaft 68 therein. Inserts 70 are positioned on the shaft 68 between the sleeves 66. Chains 72 and 74 are secured to the end caps 76 and 78 mounted on the ends of shaft 68 and extend upwardly therefrom. Preferably, the chains 72 and 74 are secured to a rotator means 80 such as commonly used on hydraulic post hole diggers to permit the selective rotation of the assembly 10 so that the assembly 10 may be properly oriented with respect to the blocks to be lifted and carried and to permit the blocks to be properly positioned adjacent the work site.

Thus it can be seen that the invention accomplishes at least all of its stated objectives.

I claim:

1. A concrete block tong assembly, comprising:

a first horizontally disposed shaft having first and second ends;

a plurality of horizontally spaced-apart top tubes having first and second ends;

said first ends of said top tubes being operatively rotatably connected to said first shaft;

a front plate secured to said first end of each of said top tubes and extending downwardly therefrom;

a plurality of horizontally spaced-apart bottom tubes having first and second ends;

said first ends of said top tubes being pivotally secured to said first ends of said bottom tubes;

said bottom tubes having a greater length than said top tubes;

said top tubes being positioned above said bottom tubes;

said top tubes being pivotally movable from a first position to a second position with respect to said bottom tubes;

said second ends of said top tubes being positioned closely adjacent said bottom tubes when in their said first position;

said top and bottom tubes being substantially parallel to one another when said top tubes are in their said first position;

said top tubes being angularly disposed with respect to said bottom tubes when in their said second positions;

a second shaft operatively secured to said top tubes adjacent said second ends thereof and extending therebetween;

a back plate secured to each of said bottom tubes adjacent said second end thereof which extends downwardly therefrom;

an upstanding support secured to each of said bottom tubes adjacent said second end of the associated top tube;

a dead bolt slidably mounted in each of said top tubes and being movable between an extended position and a retracted position;

said dead bolts being in operative engagement with said upstanding supports, when in their said extended position, to maintain said top tubes in their said first position with respect to said bottom tubes;

and a motive means associated with each of said dead bolts for causing the movement thereof;

said second shaft adapted to have a lifting means associated therewith.

2. The assembly of claim 1 wherein said first motive means comprises an electric solenoid mounted on each of said top tubes.

3. The assembly of claim 2 wherein said solenoids move said dead bolts from their said extended positions to their said retracted positions.

4. The assembly of claim 3 wherein a spring is associated with each of said dead bolts for moving said dead bolts from their said retracted positions to their said extended positions when said solenoids have been deenergized.

5. The assembly of claim 1 wherein said back plates are selectively longitudinally adjustably secured to said top tubes.

6. The assembly of claim 1 wherein a chain member is secured to each end of said second shaft which extends upwardly therefrom and wherein rotation means is secured to said chain members for rotating the block tong assembly.

7. A concrete block tong assembly, comprising:

a first horizontally disposed shaft having first and second ends;

a plurality of horizontally spaced-apart top tubes having first and second ends;

said first ends of said top tubes being operatively rotatably connected to said first shaft;

a front plate secured to said first end of each of said top tubes and extending downwardly therefrom;

a plurality of horizontally spaced-apart bottom tubes having first and second ends;

said first ends of said top tubes being pivotally secured to said first ends of said bottom tubes;

said bottom tubes having a greater length than said top tubes;

said top tubes being positioned above said bottom tubes;

said top tubes being pivotally movable from a first position to a second position with respect to said bottom tubes;

said second ends of said top tubes being positioned closely adjacent said bottom tubes when in their said first position;

said top and bottom tubes being substantially parallel to one another when said top tubes are in their said first position;

said top tubes being angularly disposed with respect to said bottom tubes when in their said second positions;

a second shaft operatively secured to said top tubes adjacent said second ends thereof and extending therebetween;

a back plate secured to each of said bottom tubes adjacent said second end thereof which extends downwardly therefrom;

an upstanding support secured to each of said bottom tubes adjacent said second end of the associated top tube;

a dead bolt slidably mounted in each of said top tubes and being movable between an extended position and a retracted position;

said dead bolts being in operative engagement with said upstanding supports, when in their said extended position, to maintain said top tubes in their said first position with respect to said bottom tubes;

said second shaft adapted to have a lifting means associated therewith.

* * * * *